US006677518B2

(12) United States Patent
Hirakawa et al.

(10) Patent No.: US 6,677,518 B2
(45) Date of Patent: Jan. 13, 2004

(54) DATA TRANSMISSION CABLE

(75) Inventors: Yoshihiro Hirakawa, Yokohama (JP); Seiji Endo, Kanuma (JP); Atsushi Tsujino, Kanuma (JP); Yuji Ochi, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/191,299

(22) Filed: Jul. 10, 2002

(65) Prior Publication Data

US 2003/0150633 A1 Aug. 14, 2003

(30) Foreign Application Priority Data

Feb. 8, 2002 (JP) ..... P2002-032951

(51) Int. Cl.[7] ..... H01B 7/18
(52) U.S. Cl. ..... 174/36
(58) Field of Search ..... 174/36, 103, 113 R, 174/117 F

(56) References Cited

U.S. PATENT DOCUMENTS 4,847,448 A * 7/1989 Sato ..... 174/103
4,980,223 A * 12/1990 Nakano et al. ..... 428/198
5,142,100 A 8/1992 Vaupotic
5,275,861 A * 1/1994 Vaughn ..... 428/76
5,329,064 A 7/1994 Tash et al.
5,483,020 A 1/1996 Hardie et al.
5,574,260 A 11/1996 Broomall et al.
5,956,445 A * 9/1999 Deitz et al. ..... 385/100
6,010,788 A 1/2000 Kebabjian et al.

FOREIGN PATENT DOCUMENTS

WO WO 01/08167 2/2001

OTHER PUBLICATIONS

Notification of Transmittal of the International Search Report or the Declaration, Form PCT/ISA/220; (PCT/JP03/01301), dated May 12, 2003 and International Search Report, Form PCT/ISA/210, dated May 12, 2003.

* cited by examiner

*Primary Examiner*—Chau N. Nguyen
(74) *Attorney, Agent, or Firm*—Smith, Gambrell & Russell, LLP

(57) ABSTRACT

The present invention relates to a data transmission cable and the like including a structure reducing the frequency dependence of cable attenuation in digital transmission, thereby suppressing signal distortions. The data transmission cable includes at least a pair of conductors, each coated with an insulator, extending along a predetermined direction; and a shield tape, provided so as to surround the conductors, including a metal layer. In particular, in the shield tape, the metal layer has a thickness of 1 $\mu$m or more but 10 $\mu$m or less, preferably 2 $\mu$m or more but 6 $\mu$m or less.

8 Claims, 10 Drawing Sheets

DATA TRANSMISSION CABLE

BACKGROUND OF THE INVENTION

1. Field of the Invention

The present invention relates to a data transmission cable and the like having a structure suitable for digital transmission.

2. Related Background Art

As a data transmission cable, a differential data transmission cable, for example, comprises a structure in which a shield is provided so as to cover a pair of conductors each coated with an insulator. Since the shield itself cannot be an ideal conductor, an eddy current occurs when an electric field is formed on the shield. It has been known that apparent conductor resistance increases due to the Joule loss caused by the occurrence of the eddy current thus confined within the shield.

Conventionally, for reducing such a Joule loss, it has been necessary to lower the ohmic value of the shield, whereby measures, for example, such as using a metal film with a high conductivity as a shield or preparing a shield having a sufficient thickness, for example, have been taken.

SUMMARY OF THE INVENTION

The inventors studied conventional data transmission cables and, as a result, have found a problem as follows. Namely, due to skin effect, the eddy current generated within a shield is distributed closer to the surface as the frequency is higher, while having the same frequency as that of signals transmitted. Therefore, the Joule loss becomes greater as the frequency is higher, whereby conductor resistance (Q/m) becomes greater as the frequency is higher as indicated by curve G100 in FIG. 1. In particular, the effectiveness of the thicker shield decreases as the frequency band for signal transmission is higher.

In the digital transmission using a conventional data transmission cable, there has usually been a problem that, due to the dependence of conductor resistance on frequency (curve G100 in FIG. 1), signal deterioration is caused by the increase of conductor resistance, which makes it difficult to maintain a sufficient transmission quality on the higher frequency band side.

In order to overcome the problem mentioned above, it is an object of the present invention to provide a data transmission cable comprising a structure for suppressing signal distortions by improving the frequency dependence of cable attenuation in digital transmission; and a communication method, a system, and a cord equipped with a connector which utilize the data transmission cable.

For achieving the above-mentioned object, the data transmission cable according to the present invention is directed to a differential data transmission cable which can yield an excellent effect of reducing the frequency dependence preferably in a transmission band of 100 Mbps to 3 Gbps. It comprises at least a pair of conductors, each coated with an insulator, extending along a predetermined direction; and a shield tape, disposed so as to surround the insulated conductors, including a metal layer covering the insulated conductors. In particular, in the shield tape, the metal layer covering the insulated conductors has a thickness of 1 $\mu$m or more but 10 $\mu$m or less, preferably 2 $\mu$m or more but 6 $\mu$m or less.

Here, a skin thickness which is the depth into the shield tape of distribution of an eddy current generated on the shield tape accompanying digital transmission, as the thickness of the metal layer, is given by the following expression (1):

$$\frac{1}{\sqrt{\pi \cdot \delta \cdot \mu \cdot f}} \tag{1}$$

where f is the fundamental frequency (Hz) of digital signals transmitted, $\delta$ is the conductivity (mho/m) of the metal layer, and $\mu$ is the magnetic permeability (H/m) of the metal layer.

Here, with respect to the digital signal transmitted, the thickness of the metal layer is designed so as to become 50% or more but 300% or less of the skin thickness given by the above-mentioned expression (1).

The data transmission cable comprising a shield tape including the above-mentioned metal layer can reduce the eddy current confined within the metal layer but cannot at all prevent the eddy current from being generated. Therefore, the present invention controls the shield tape, the thickness of the metal layer in particular, so as to intentionally enhance and reduce the conductor resistance on the lower and higher frequency band sides, respectively, as indicated by arrows A1 and A2 in FIG. 1, thereby realizing a reduction in the frequency dependence of cable attenuation over the whole signal wavelength band, i.e., gain flattening. The data transmission cable according to the present invention uses a technique in which the conductor resistance generated by the eddy current confined within the metal layer included in the shield tape is positively utilized on the lower frequency band side in particular, so that no signals are required to be transmitted directly, whereby similar effects can be obtained whether the metal layer is grounded or not. The transmission band used for the data transmission cable according to the present invention includes at least one of the lower frequency band, in which the conductor resistance is enhanced, and the higher frequency band, in which the conductor resistance is reduced. Namely, the scope of the present invention includes a structure and usage for reducing the frequency dependency.

The shield tape may be constituted either by the metal layer alone or by a multilayer structure composed of the metal layer and an insulating layer such as a plastic material. When the shield tape comprises a multilayer structure, the metal layer is arranged so as to cover the insulated conductors.

The data transmission cable according to the present invention may comprise a drain wire extending in the predetermined direction while in a state accommodated inside the shield tape together with the insulated conductors. Also, the data transmission cable may comprise an outermost layer of an insulating material arranged on the outer periphery of the shield tape. Inversely, when the shield tape comprises a multiplayer structure and the data transmission cable does not have the drain wire, the metal layer can be arranged on the outer periphery of the shield tape.

The data transmission cable according to the present invention may comprise a metal material layer disposed so as to surround the outer periphery of the shield tape. When an outermost layer is provided so as to surround the outer periphery of the shield tape, it is preferred that the metal material layer be disposed between the shield tape and the outermost layer.

The data transmission cable according to the present invention may include a plurality of cable units each having a structure identical to that of the data transmission cable having the structure mentioned above.

A transmission system employing the data transmission cable comprising the above-mentioned structure realizes a communication method which effectively reduces the frequency dependence of cable attenuation preferably in a transmission band including a signal wavelength band (100 Mbps to 3 Gbps). When a cord equipped with a connector in which a connector is connected to a leading end of the data transmission cable is constructed, it can be applied to various systems such as semiconductor tester apparatus, LAN, high-speed computer line.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 2A is a view showing the overall structure of a first embodiment of the data transmission cable according to the present invention, whereas

FIG. 3A is a view showing the overall structure of a second embodiment of the data transmission cable according to the present invention, whereas

DETAILED DESCRIPTION OF THE PREFERRED EMBODIMENTS

Figure 1:
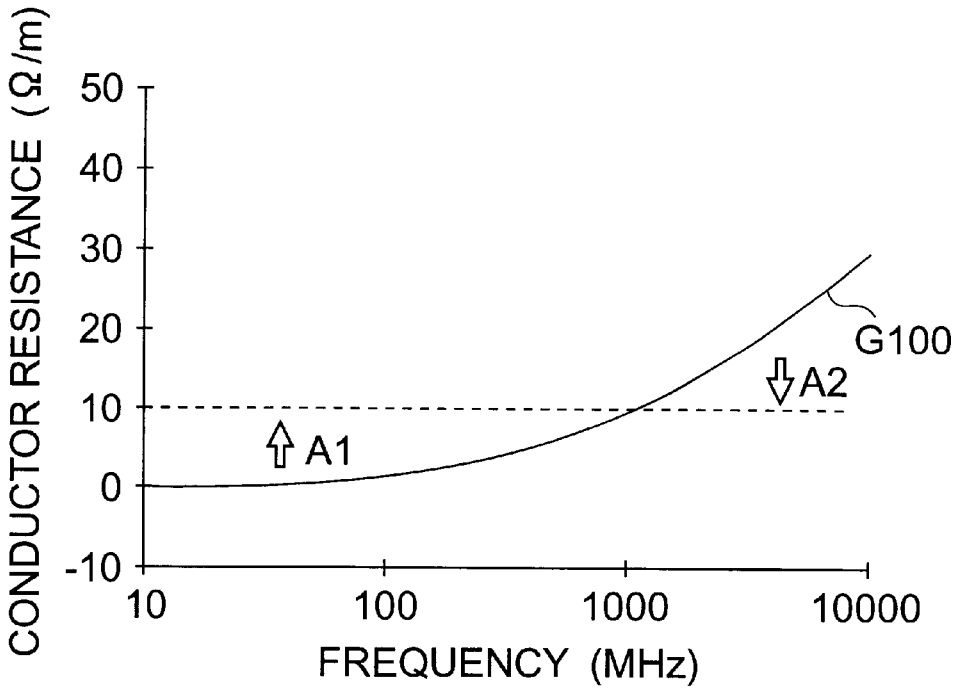
FIG. 1 is a graph showing a frequency characteristics of conductor resistance (Ω/m) in a conventional data transmission cable.

In the following, embodiments concerning the data transmission cable according to the present invention and its applications will be explained with reference to FIGS. 2A to 6B and 7 to 11. In the explanation of the drawings, constituents identical to each other will be referred to with numerals identical to each other without repeating their overlapping descriptions. FIG. 1 will also be referred to when necessary.

Figure 2A:
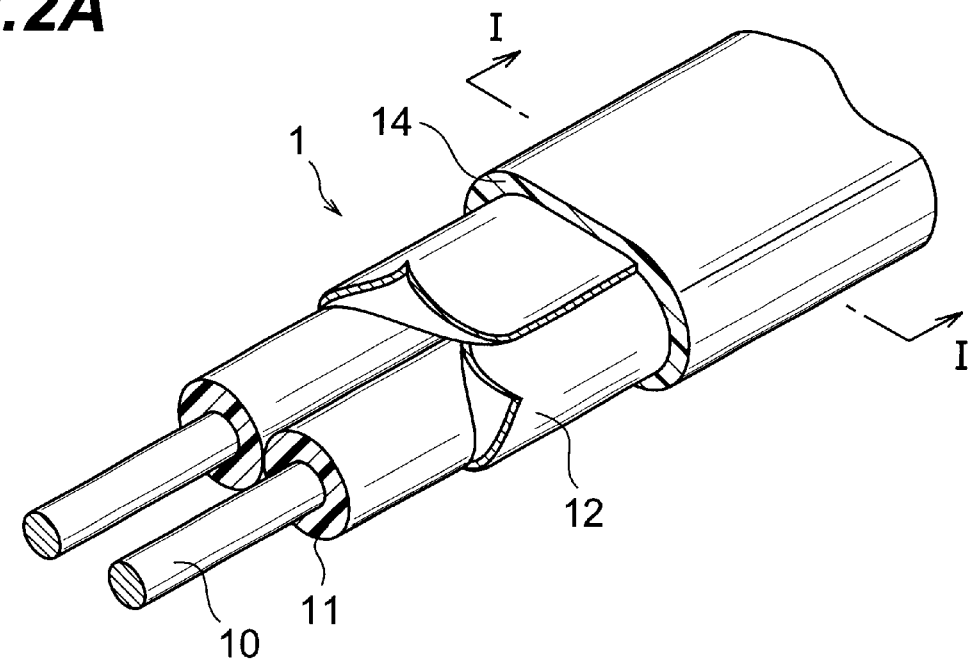
Figure 2B:
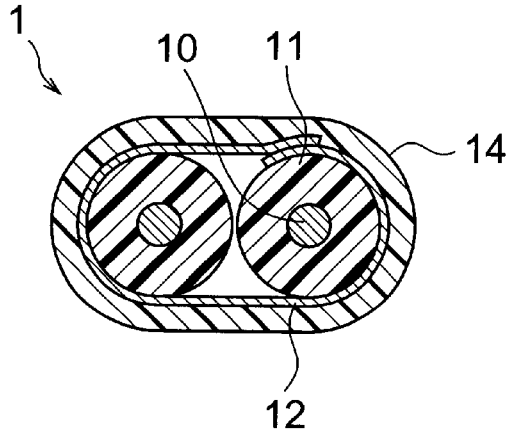
FIG. 2B is a view showing the cross-sectional structure taken along the line I—I in FIG. 2A.

FIG. 2A is a view showing the overall configuration of a first embodiment of the data transmission cable according to the present invention, whereas FIG. 2B is a view showing the cross-sectional structure taken along the line I—I in FIG. 2A.

As shown in FIGS. 2A and 2B, the data transmission cable 1 according to the first embodiment has conductors 10 each of which is coated with an insulator 11 such as a plastic material. Further, a shield tape 12 is formed over the outer periphery of the conductors 10, whereas a resin layer (outermost layer) 14 is further provided so as to cover the shield tape 12 surrounding the conductors 10. FIGS. 2A and 2B show a differential data transmission cable comprising at least a pair of conductors 10 as the data transmission cable 1 according to the first embodiment.

Figure 3A:
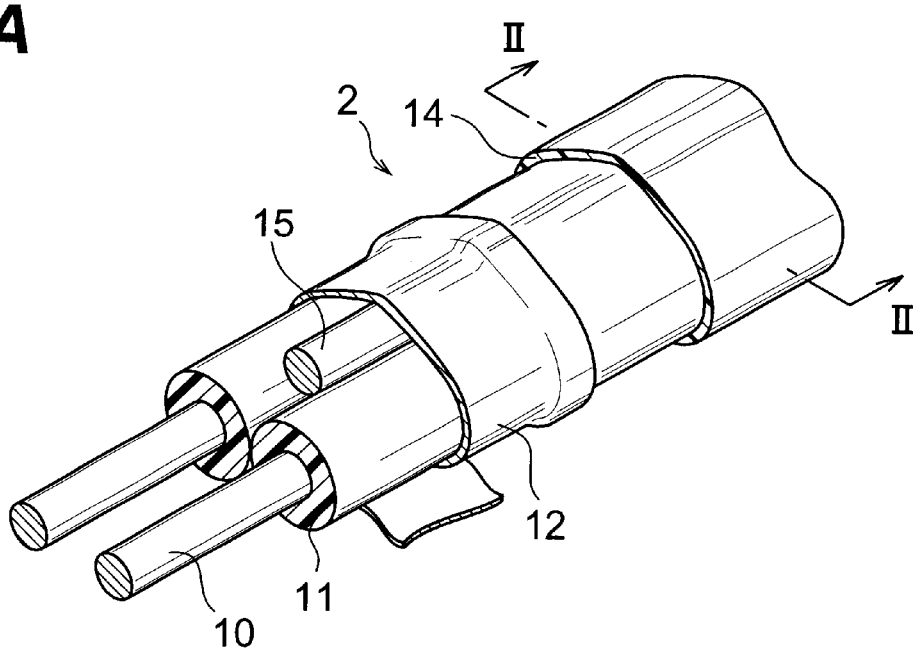
Figure 3B:
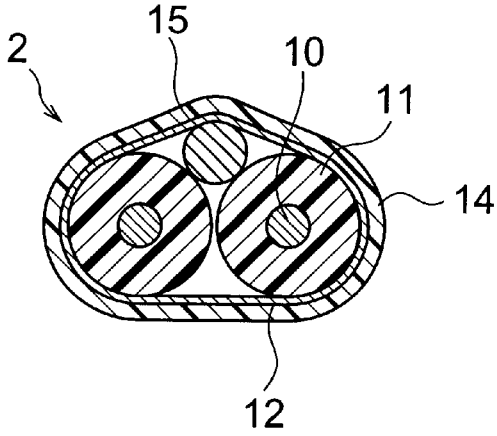
FIG. 3B is a view showing the cross-sectional structure taken along the line II—II in FIG. 3A.

As shown in FIGS. 3A and 3B, on the other hand, the data transmission cable 2 according to the second embodiment is also represented as a differential data transmission cable having at least a pair of conductors 10. Here, FIG. 3A is a view showing the overall configuration of a second embodiment of the data transmission cable according to the present invention, whereas FIG. 3B is a view showing the cross-sectional structure taken along the line II—II in FIG. 3A.

In the second embodiment, as in the first embodiment, each of the conductors 10 is coated with an insulator 11 such as a plastic material, whereas the outer periphery of the insulators 11 is successively covered with a shield tape 12 and a resin layer (outermost layer) 14. In the data transmission cable 1 according to the second embodiment, a grounding drain wire 15 is provided along the conductors 10, so as to be contained inside the shield tape 12 together with the conductors 10. The position of the drain wire 15 is not confined as shown in FIG. 3A. The drain wire 15 may be located in a horizontal position so as to be adjacent to or at the middle of the conductors 10 like a flat ribbon tape shape.

In each embodiment, various methods can be considered for covering the conductors 10 (coated with the insulators 11) with the shield tape 12. As an example, the conductors 10 may be wrapped with the shield tape 12 such that both ends of the shield tape 12 overlap each other along the longitudinal direction of the conductors 10 even in the second embodiment, or the shield tape 12 may be wound about the conductors 10 as shown in FIG. 3A even in the first embodiment.

Figure 4A:
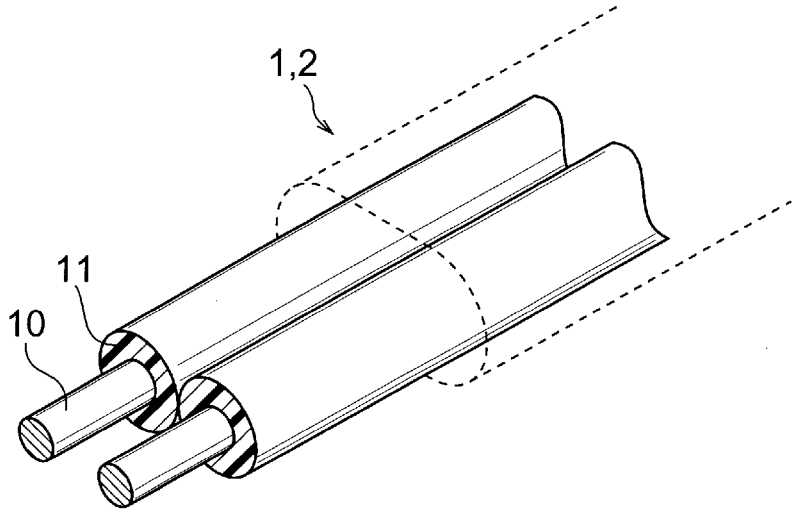
FIGS. 4A and 4B are views for explaining modes of introducing conductors into a data transmission cable.
Figure 4B:
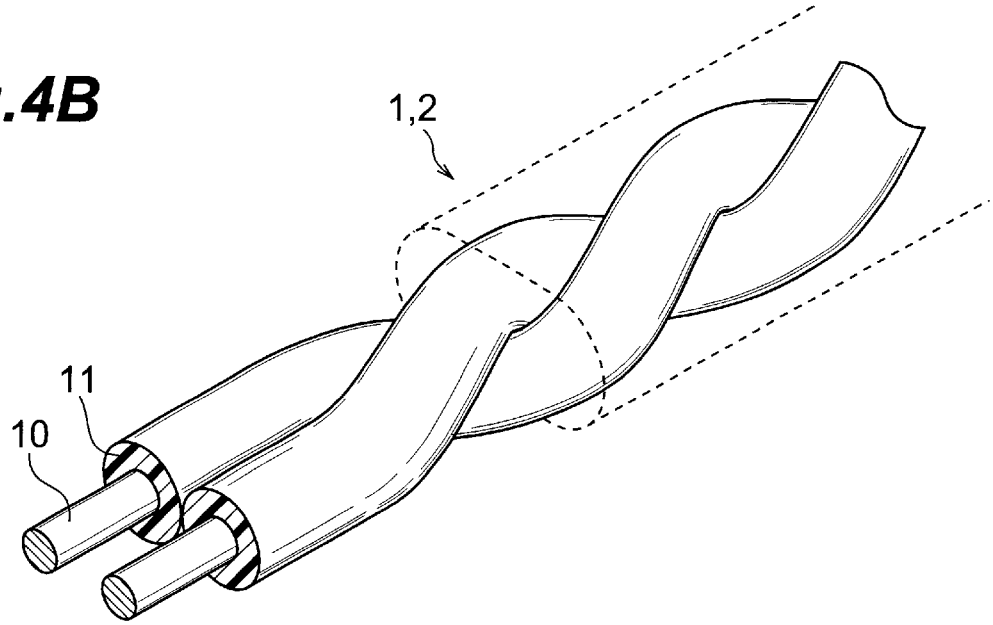

When the data transmission cables 1, 2 according to the first and second embodiments are differential data transmission cables, at least a pair of conductors contained inside the resin layer 14 may be located either in a state parallel to each other as shown in FIG. 4A or in a state twisted together as shown in FIG. 4B.

Figure 5A:
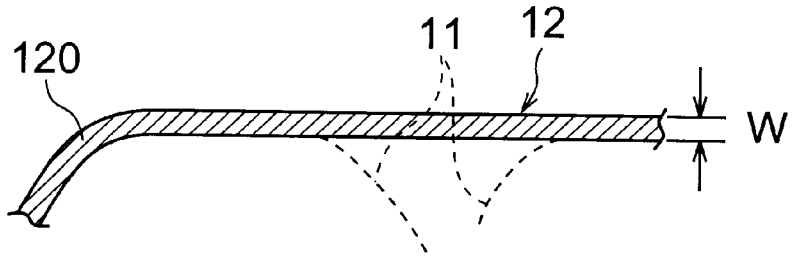
FIGS. 5A and 5B are views showing cross-sectional structures of shield tapes.
Figure 5B:
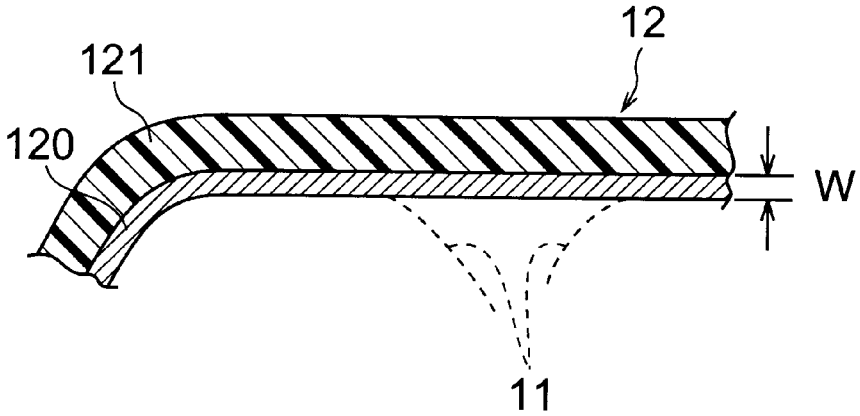

FIGS. 5A and 5B are views showing cross-sectional structures of the shield tape 12. The shield tape 12 may comprise a single metal layer 120 preferably made of aluminum (Al), copper (Cu), or an alloy including one of them having a thickness of W as shown in FIG. 5A, or may be constituted by a metal layer 120 having a thickness of W and a insulating layer 121 as shown in FIG. 5B. (In the following explanation, "aluminum" and "copper" will always encompass their alloys even when simply mentioned as they are.) When the shield tape 12 has a multilayer structure made of the metal layer 120 and insulating layer 121, however, it is preferred that the metal layer 120 be arranged so as to dispose toward the conductors 10. A metal net may be provided on the outside of the shield tape 12.

Figure 6A:
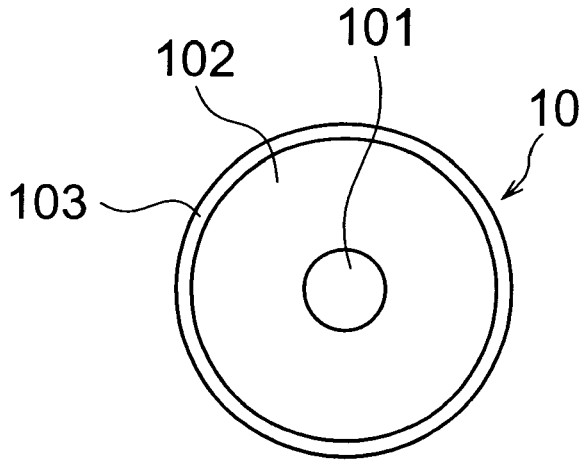
FIGS. 6A and 6B are views showing cross-sectional structures of conductors.
Figure 6B:
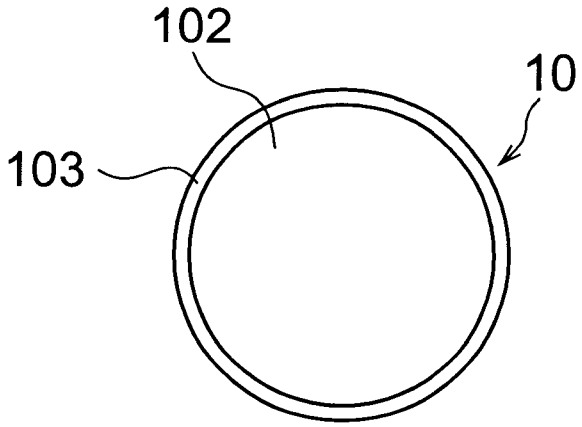

FIGS. 6A and 6B are views showing respective examples of the cross-sectional structure of a conductor 10, applicable to the present invention. FIG. 6A shows, as a cross-sectional structure of the conductor 10, one comprising a steel wire 101 disposed at the center, a copper layer (made of copper or a copper alloy) 102 disposed on the outer periphery of the steel wire 101, and a silver layer 103 coated on the surface of the copper layer 102. On the other hand, FIG. 6B shows, as a cross-sectional structure of the conductor 10, one comprising a copper layer (made of copper or a copper alloy) 102 and a silver layer 103 coated on the surface of the copper layer 102.

The data transmission cable according to the present invention comprises a structure which controls the thickness of the shield tape, the thickness of the metal layer in particular, so as to intentionally enhance and reduce the conductor resistance on the lower and higher frequency band sides, respectively, as indicated by arrows A1 and A2 in FIG. 1, thereby realizing a reduction in the frequency dependence of cable attenuation over the whole signal wavelength band, i.e., gain flattening.

In particular, a skin thickness which is the depth into the shield tape of distribution of an eddy current generated on the shield tape accompanying digital transmission, as the thickness of the metal layer, is given by the following expression (2):

$$\frac{1}{\sqrt{\pi \cdot \delta \cdot \mu \cdot f}} \tag{2}$$

where f is the fundamental frequency (Hz) of a digital signal transmitted, δ is the conductivity (mho/m) of the metal layer, and $\mu$ is the magnetic permeability (H/m) of the metal layer.

Here, with respect to the digital signal transmitted, the thickness of the metal layer is designed so as to become 50% or more but 300% or less of the skin thickness given by the above-mentioned expression (2).

Specifically, in the above-mentioned shield tape, the metal layer disposed toward the conductors has a thickness of 1 $\mu$m or more but 10 $\mu$m or less, preferably 2 $\mu$m or more but 6 $\mu$m or less.

Figure 7:
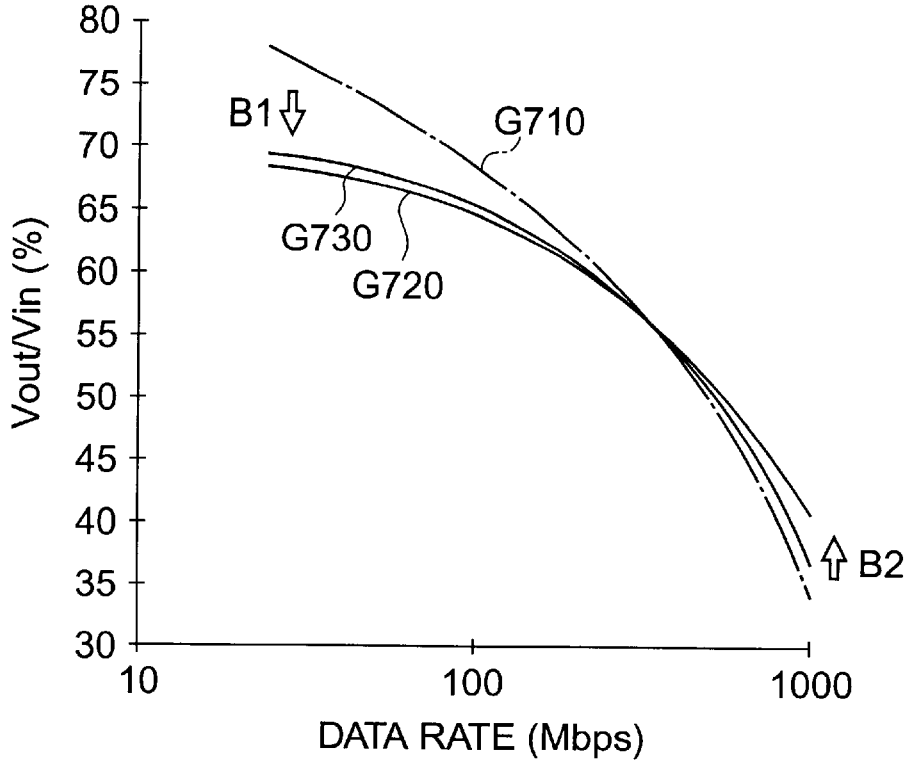
FIG. 7 is a graph showing relationships between data rate (Mbps) and cable attenuation ratio $V_{out}/V_{in}$ (%) concerning data transmission cables according to the present invention and the conventional data transmission cable.

FIG. 7 is a graph showing relationships between data rate (Mbps) and cable attenuation ratio $V_{out}/V_{in}$ (%) concerning data transmission cables according to the present invention and the conventional data transmission cable.

In this graph, curve G710 indicates the relationship between data rate (Mbps) and cable attenuation ratio $V_{out}/V_{in}$ (%) concerning a cable sample which is a comparative example. The cable sample of this comparative example is a metal cable comprising conductors having the cross-sectional structure shown in FIG. 6B, and its structure substantially corresponds to that shown in FIG. 3A without a shield tape. The conductors are silver-plated annealed copper wires.

Curves G720 and G730 represent respective cable samples prepared as data transmission cables according to the present invention. Each of the cable sample has the same structure as shown in FIG. 3A and, in each cable sample, conductors are made of a 5 $\mu$m-thick silver-plated copper alloy. The cable sample corresponding to curve G720 comprises a shield tape including a metal layer of copper having a thickness of 6 $\mu$m. The cable sample corresponding to curve G730 comprises a shield tape including a metal layer of copper having a thickness of 3.5 $\mu$m.

As can be seen from FIG. 7, when compared with the frequency dependence of cable attenuation in the cable sample of the comparative example (curve G710), the frequency dependence characteristic of cable attenuation in each of the cable samples prepared as data transmission cables according to the present invention (curves G720 and G730) decreases and increases on the lower and higher frequency band sides, respectively, thereby yielding a flat characteristic as a whole (the cable attenuation is controlled in the directions of arrows B1 and B2 in FIG. 7).

Figure 8:
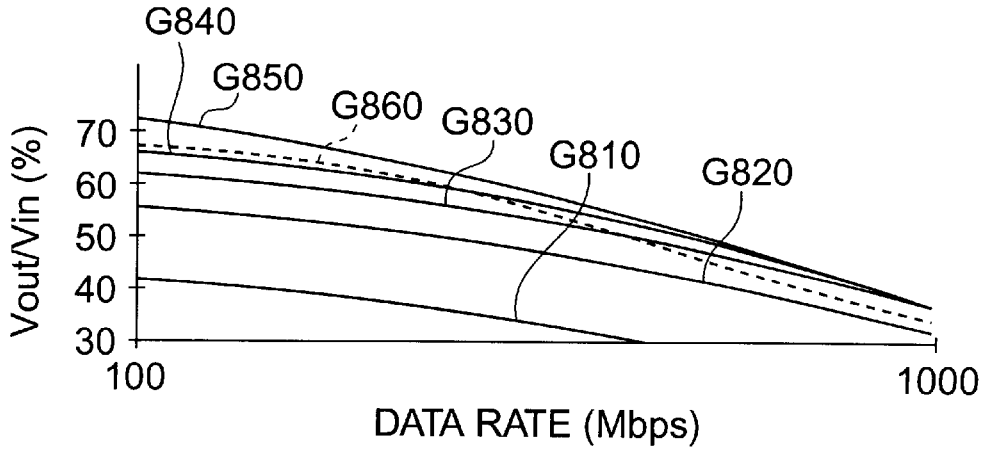
FIG. 8 is a graph showing relationships between data rate (Mbps) and cable attenuation ratio $V_{out}/V_{in}$ (%) concerning data transmission cables according to the present invention and the conventional data transmission cable.

FIG. 8 is a graph showing relationships between data rate (Mbps) and cable attenuation ratio $V_{out}/V_{in}$ (%) concerning a plurality of cable samples prepared as data transmission cables according to the present invention.

In each cable sample, conductors are made of a 5 $\mu$m-thick silver-plated copper alloy having the cross-sectional structure shown in FIG. 6B. The cable samples have respective shield tapes including metal layers with thicknesses different from each other. Curve G810 indicates the frequency dependence of cable attenuation in a cable sample employing an 1 $\mu$m-thick copper layer as the metal layer included in the shield tape. Curve G820 indicates the frequency dependence of cable attenuation in a cable sample employing a 2 $\mu$m-thick copper layer as the metal layer included in the shield tape. Curve G830 indicates the frequency dependence of cable attenuation in a cable sample employing a 3 $\mu$m-thick copper layer as the metal layer included in the shield tape. Curve G840 indicates the frequency dependence of cable attenuation in a cable sample employing a 4 $\mu$m-thick copper layer as the metal layer included in the shield tape. Curve G850 indicates the frequency dependence of cable attenuation in a cable sample employing a 9 $\mu$m-thick copper layer as the metal layer included in the shield tape. Curve G860 indicates the frequency dependence of cable attenuation in a cable sample employing a 7 $\mu$m-thick aluminum layer as the metal layer included in the shield tape.

As can be seen from FIG. 8, the metal layer thickness considered most effective in reducing the frequency dependence of cable attenuation, i.e., flattening gain, is 4±2 $\mu$m (2 $\mu$m to 6 $\mu$m). However, typical examples of method of forming a shield tape include a method of depositing a metal layer on an insulating film, and a method of directly bonding an insulating film and a metal film to each other. In the case of metal deposition, metal layers formed thereby have a thickness of less than 1 $\mu$m in general, which fails to yield a satisfactory effect of realizing the flattening of gain as in data transmission cables according to the present invention. In the case of sheet metal bonding onto an insulating film, on the other hand, the thickness of the metal layer prepared usually exceeds 10 $\mu$m, which also fails to yield a satisfactory effect of realizing the flattening of gain as in data transmission cables according to the present invention. Therefore, it is preferred that the thickness of the metal layer be 1 $\mu$m to 10 $\mu$m in practice.

A multicore cable utilizing a plurality of cable units each comprising the data transmission cable having the above-mentioned structure can also be constructed.

A data transmission cable employing the drain wire 15 or the like as a grounding line and including therewithin a shield tape having the above-mentioned structure can be effective in reducing the frequency dependence of cable attenuation (flattening gain) in cases where inter-apparatus connections having an ohmic value as low as a DC level must be realized as a ground and where it is necessary that full shielding from external noises be realized, for example. Though a higher effect (frequency dependence reducing effect) can be obtained when the shield tape is electrically isolated from grounding conductors and the like, it is still effective to some extent even when completely or incompletely grounded, which yields higher expandability in use.

Figure 9:
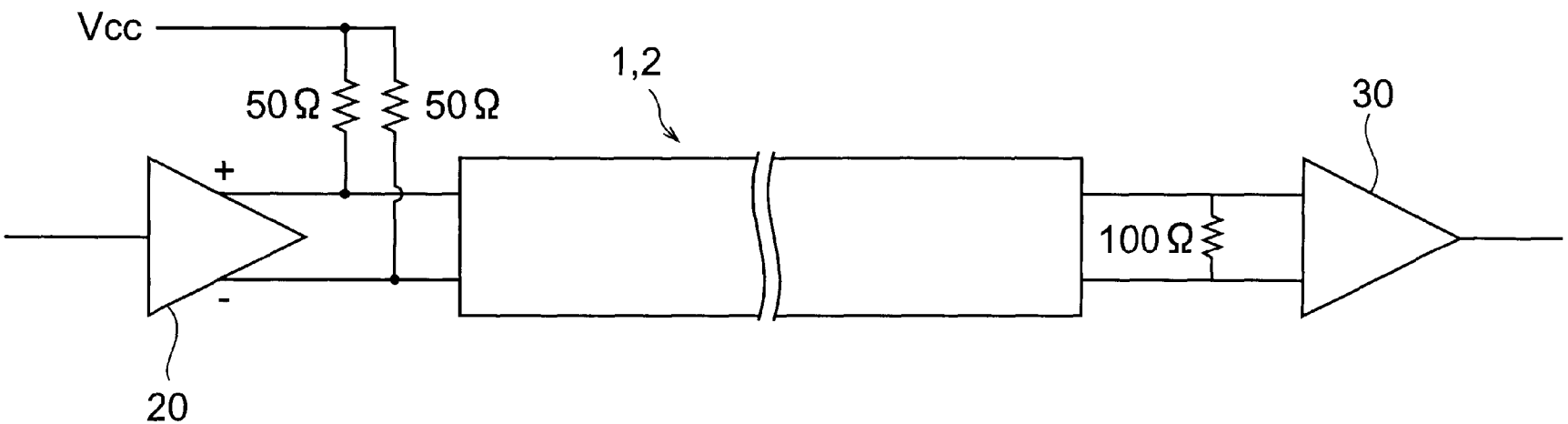
FIG. 9 is a view showing the configuration of a transmission system as a system employing a data transmission cable according to the present invention.

FIG. 9 is a view showing the configuration of a transmission system as a typical system employing a data transmission cable according to the present invention. The transmission system shown in FIG. 9 comprises a data transmission cable 1 or 2 having the above-mentioned structure, a signal outputting driver 20 electrically connected to one end of the data transmission cable 1, 2, and a receiver 30 for receiving signals propagated through the data transmission cable 1, 2. This configuration yields a transmission system suitable for digital transmission in a transmission band of 100 Mbps to 3 Gbps.

Figure 10:
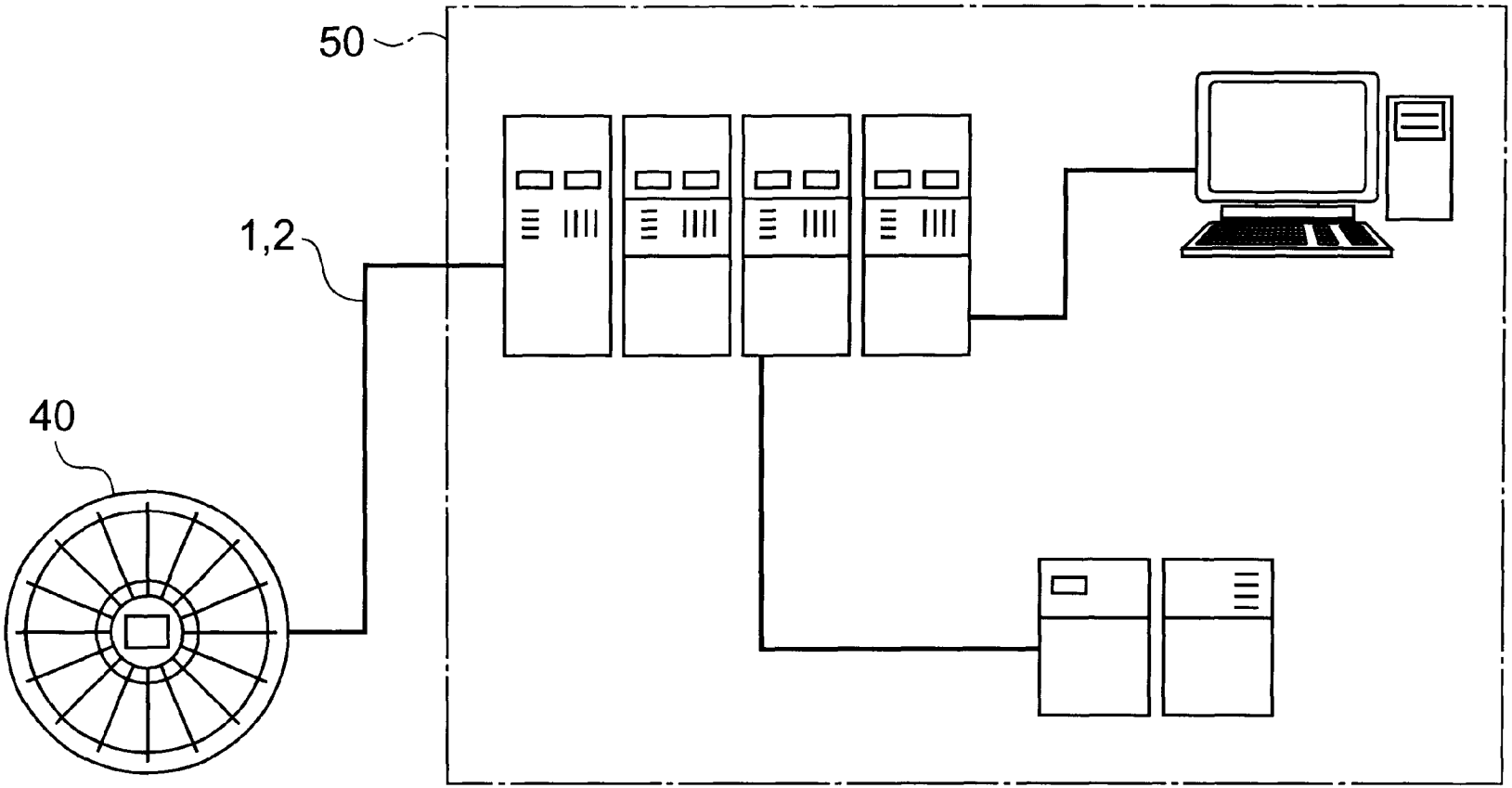
FIG. 10 is a view showing the configuration of a semiconductor tester apparatus as a system employing a data transmission cable according to the present invention.

The data transmission cable is applicable not only to the above-mentioned transmission system, but also to a system constituting a semiconductor tester apparatus or the like. FIG. 10 is a view showing the schematic configuration of the semiconductor tester apparatus. This semiconductor tester apparatus comprises a semiconductor tester 40 and a system unit 50 including an arithmetic section, an external storage section, a peripheral device, and the like. The data transmission cable 1 or 2 constitutes a part of a transmission system between the semiconductor tester 40 and the system unit 50.

Figure 11:
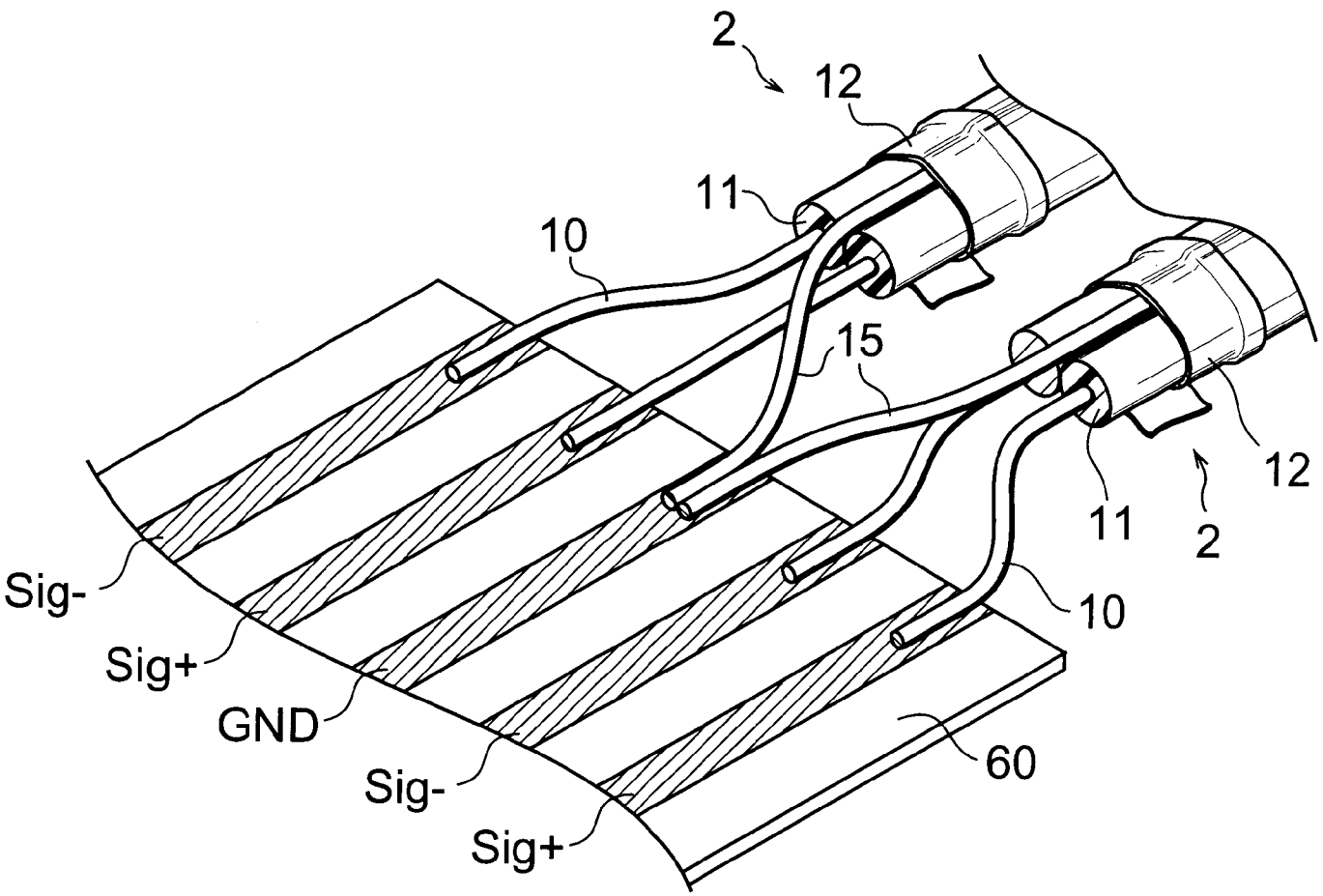
FIG. 11 is view showing the configuration of a cord equipped with a connector, which employs a data transmission cable according to the present invention.

FIG. 11 is a view showing the configuration of a cord equipped with a connector in which a connector 60 is connected to leading ends of data transmission cables 2 comprising the structure shown in FIGS. 3A and 3B, the inter-terminal connecting part thereof in particular. Such a cable equipped with a connector is suitable for digital transmission (preferably within the transmission range of 100 Mbps to 3 Gbps) over a distance of 5 m to 20 m, or further over a distance of 1 m to 100 m.

In accordance with the present invention, as mentioned above, the thickness of the metal layer included in the shield tape covering conductors is set so as to intentionally enhance and reduce conductor resistance on the lower and higher frequency band sides, respectively, whereby the frequency dependence of cable attenuation can be reduced over the whole signal wavelength band. As a result, eye height and zero-crossing jitter increase and decrease, respectively, in differential transmission in particular.

Since the conductor resistance raised by the eddy current confined within the metal layer included in the shield tape is positively utilized in the present invention, no signals are required to be sent directly, whereby similar effects can be obtained whether the metal layer is grounded or not.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A data transmission cable comprising:

at least a pair of conductors, each coated with an insulator, extending along a predetermined direction; and a shield tape, provided so as to surround said conductors, including a metal layer facing said conductors, said metal lave having a thickness of 1 $\mu$m or more but 10 $\mu$m or less;

wherein said metal layer has a thickness which is 50% or more but 300% or less of the skin thickness given by the following expression:

$$\frac{1}{\sqrt{\pi \cdot \delta \cdot \mu \cdot f}}$$

where f is the fundamental frequency (Hz) of digital signals transmitted, $\delta$ is the conductivity (mho/m) of said metal layer, and $\mu$ is the magnetic permeability (H/m) of said metal layer.

2. A data transmission cable according to claim 1, further comprising a drain wire extending in said predetermined direction while in a state accommodated inside said shield tape together with said conductors.

3. A data transmission cable according to claim 1, wherein said shield tape includes said metal layer and an insulating layer provided on one side of said metal layer.

4. A data transmission cable according to claim 1, further comprising an outermost layer of an insulating material provided on an outer periphery of said shield tape.

5. A data transmission cable including a plurality of cable units each having a structure identical to that of a data transmission cable according to claim 1.

6. A communication method comprising the step of carrying out differential transmission through a pair of conductors in a data transmission cable according to claim 1.

7. A system including the data transmission cable according to claim 1.

8. A cord equipped with a connector comprising:

a data transmission cable according to claim 1; and terminals electrically connected to respective conductors included in said data transmission cable.

* * * * *